United States Patent [19]

Mohtasham

[11] Patent Number: 4,963,706

[45] Date of Patent: Oct. 16, 1990

[54] SAFETY SWITCH ASSEMBLIES

[75] Inventor: Mehdi Mohtasham, Manchester, United Kingdom

[73] Assignee: EJA Engineering Company Limited, Wigan, England

[21] Appl. No.: 296,501

[22] Filed: Jan. 12, 1989

[51] Int. Cl.[5] ..... H01H 21/84; H01H 13/52

[52] U.S. Cl. ..... 200/334; 200/17 R; 200/43.07; 200/302.1; 200/61.62; 200/533; 200/573

[58] Field of Search ..... 200/43.04, 43.07, 50 A, 200/61.62, 61.71, 302.2, 518, 533, 537, 573, 574, 334, 324, 325, 17 R

[56] References Cited

U.S. PATENT DOCUMENTS

| | | | |
|---|---|---|---|
| 4,395,608 | 7/1983 | Eicker et al. | 200/533 |
| 4,524,251 | 6/1985 | Schulz | 200/43.07 |
| 4,658,102 | 4/1987 | Seim et al. | 200/17 R |

FOREIGN PATENT DOCUMENTS

| | | |
|---|---|---|
| 0175156 | 8/1985 | European Pat. Off. . |
| 3209414 | 3/1982 | Fed. Rep. of Germany . |
| 3302631 | 8/1984 | Fed. Rep. of Germany . |
| 3309372 | 9/1984 | Fed. Rep. of Germany . |
| 3424418 | 9/1985 | Fed. Rep. of Germany . |
| 3322292 | 3/1986 | Fed. Rep. of Germany . |

*Primary Examiner*—Ernest G. Cusick

*Attorney, Agent, or Firm*—Spensley Horn Jubas & Lubitz

[57] ABSTRACT

A safety switch assembly comprises a safety switch for securement to an enclosure having an openable closure, and an actuator for operating the safety switch for securement to the closure. The safety switch comprises a housing, containing electrical contacts, and a cam arrangement for operating the electrical contacts and formed with peripheral inwardly directed radial pockets. An axially-movable rod connects the electrical contacts and the cam arrangement. The housing has openings adjacent the cam arrangement for insertion of the actuator. The cam arrangement comprises a shaft bridging lateral walls of the housing, and an actuating cam rotatably supported on the shaft and connected to the rod by a cam follower pin connected to the rod and engaged in cam grooves in the actuating cam. An axially-movable locking cam is supported on the shaft, at each side of the actuating cam, and a spring is disposed between each locking cam and an adjacent housing wall to urge the respective locking cam towards the actuating cam and into engagement with the cam follower pin to lock the actuating cam against rotation. The actuator comprises laterally-spaced limbs insertible between the actuating cam and the locking cams axially to space same apart, and engageable with the actuating cam to rotate same axially to move the rod to operate the electrical contacts.

21 Claims, 4 Drawing Sheets

SAFETY SWITCH ASSEMBLIES

This invention relates to safety switch assemblies used especially but not exclusively in machinery guards enclosing kinetic machinery.

DESCRIPTION OF RELATED ART

Safety switch assemblies are known (see U.S. Pat. No. 4,395,608, U.S. Pat. No. 4,524,251 and DE-C-3,209,414, all in the name K.A. Schmersal GmbH & Co.) which are adapted to be fitted to an enclosure having a door, gate or protective cover, the switch assembly being adapted to switch OFF an electrical power supply when the door, gate or protective cover is opened.

These known safety switch assemblies comprise a safety switch adapted to be fitted to the enclosure and an actuator adapted to be fitted to the door, gate or protective cover and insertible into the safety switch to turn ON the electrical power supply when the enclosure is closed by the door, gate or protective cover.

The safety switch comprises within a housing normally-open contacts, one set fixed, and the other movable and carried by an axially-movable push rod spring-loaded to maintain the sets or contacts apart and the power supply consequently OFF.

The axially-movable push rod is connected to a roller cam assembly comprising a pair of roller portions axially-spaced and rotatably supported on a shaft, the push rod having a cam follower pin engagable in a cam slot in each of the roller portions. The roller portions are spring-urged towards one another but are axially-spaced by a lower end of the push rod which carries the cam follower pin. The roller portions have on their inside faces peripheral cut-away portions within which engage lateral extensions of the push rod, this engagement resisting rotation of the roller portions and consequently axial movement of the push rod and closing of the sets of contacts.

Axial separation of the roller portions breaks this engagement and permits rotation of the roller portions, axial movement of the push rod, and consequently closure of the sets of contacts.

This axial separation and rotation is effected by the actuator which has a bevel or wedge leading end to separate the roller portions followed by radial arms engagable in radial grooves in the roller portions to effect rotation therof. Each roller portion has a pair of angularly-spaced radial grooves and the housing comprises an end cap having four entries, one at the front, one at the back, and two at the end, and through a selected one of which the actuator can pass to engage in a pair of radial grooves for switch actuation.

The two actuating roller portions which form both part of the safety lock and the operating mechanism of this known safety switch assembly (i) do not form a particularly robust cam assembly due to the need for their dual axial and rotational movements, (ii) are, on occasions, not positively engaged by the actuator resulting in failure to switch ON the power supply, and (ii) can be accessed through any one of the end cap entries by a tool other than the specially designed actuator or simply by a bent piece of stiff wire to separate and rotate the roller portions to close the contacts and switch ON the electrical power supply when the door, gate or protective cover is still open so that the safety switch assembly is not tamper-proof.

It is an object of the present invention to provide a safety switch assembly of the same general character of this known safety switch assembly which obviates or mitigates the aforesaid drawbacks.

Another known safety switch assembly of the same general character as the abovedescribed Schmersal safety switch assembly (see DE-A-3,302,631, DE-A-3,309,372, DE-C-3,322,292 and DE-C-3,424,418 in the name of Hans & Jos. Kronenberg GmbH) has, within a housing, a switch-operating push rod driven by a roller cam via toggle levers and which, in turn, is rotated by an actuator engagable in a sector-like recess in the roller cam. In this instance, the roller cam has, at each side, a pivotal locking lever formed with a curved or angled slot in which engages a spindle or pin connecting the toggle levers to the push rod. The locking levers are formed with lugs which are engaged by the actuator being pushed through a slot in the housing to pivot the locking levers to allow the spindle or pin to move from a movement-restraining part of the slots to a release part of the slots thereby allowing switch closure.

This other known safety switch assembly is disadvantageous in having an indirect connection (the toggle levers and the locking levers) between the roller cam and the switch-operating push rod and there is a risk of seizure, i.e. the pin or spindle not moving from one part of the slots to the other when the actuator is inserted into the housing to engage the roller cam.

It is an object of the present invention to provide a safety switch assembly in which these disadvantages are obviated.

SUMMARY OF THE INVENTION

According to the present invention there is provided a safety switch assembly comprising (A) a safety switch for securement to an enclosure having an openable closure, and (B) an actuator for operating the safety switch for securement to the closure; (C) the safety switch comprising a housing having laterally spaced wall means, an electrical contact arrangement contained within the housing, a cam arrangement also contained within the housing for operating the electrical contact arrangement and spaced from the electrical contact arrangement, radial pocket means formed in the cam arrangement and extending inwardly of the periphery of the cam arrangement, and axially-movable rod means connecting the electrical contact arrangement and the cam arrangement to operate the electrical contact arrangement in accordance with movements of the cam arrangement, the housing defining entry means adjacent the cam arrangement for insertion of the actuator into the housing to engage the radial pocket means to operate the cam arrangement, and the cam arrangement comprising shaft means bridging the wall means of the housing, actuating cam means rotatably supported on the shaft means, connecting means operatively securing the actuating cam means to the axially-movable rod means, the connecting means including cam follower pin means connected to the axially-movable rod means and cam groove means defined by the actuating cam means and within which the cam follower pin means is engaged, locking cam means also supported on the shaft means for movement along the shaft means, and resilient means between the locking cam means and the housing wall means to urge the locking cam means towards the actuating cam means and into engagement with the cam follower pin means whereby the latter also serves releasably to lock the actuating cam means against rotation; and (D) the actuator comprising laterally-spaced limb means (i) insertible between the actuating cam means and the locking cam means axially to move the locking cam means along the shaft means away from the actuating cam means and (ii) engagable with the actuating cam means to rotate the actuating cam means axially to move the rod means to operate the electrical contact arrangement.

BRIEF DESCRIPTION OF THE DRAWINGS

An embodiment of the present invention will now be described, by way of example, with reference to the accompanying drawings, in which.

DESCRIPTION OF PREFERRED EMBODIMENT

Figure 1:
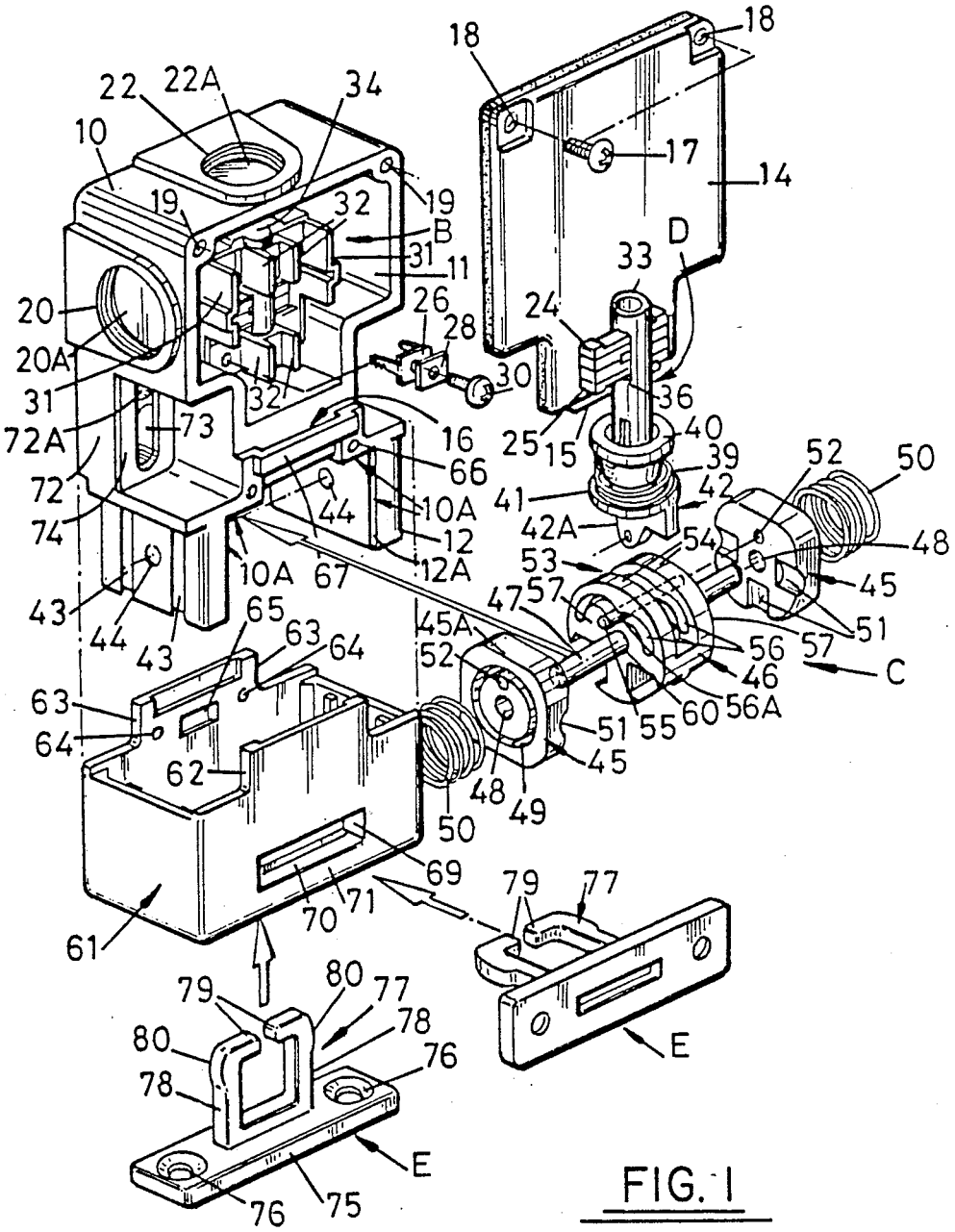
FIG. 1 is a front exploded perspective view of the safety switch assembly.
Figure 1A:
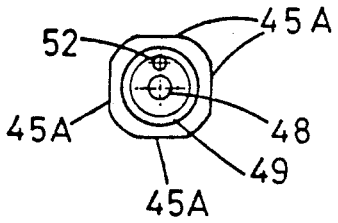
Figure 2:
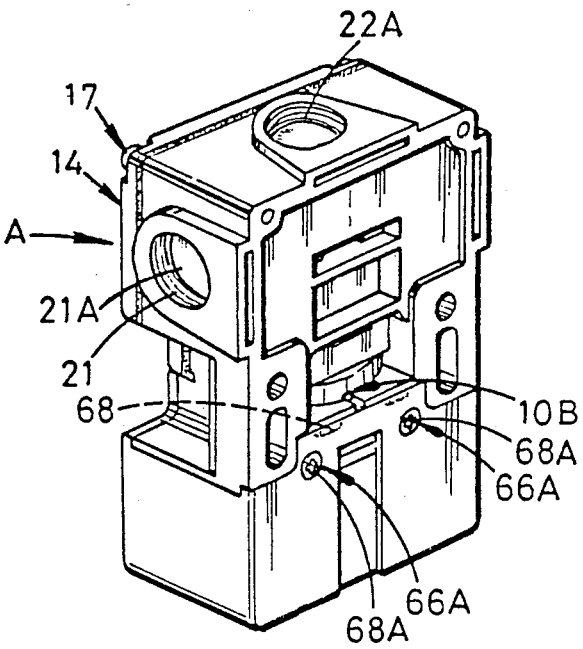
FIG. 2 is a rear view of the safety switch.
Figure 1B:
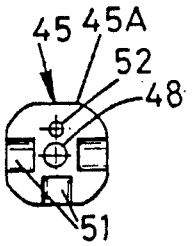
Figure 3:
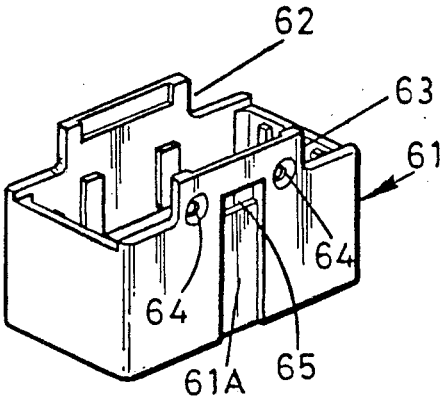
FIG. 3 is a perspective view of an end cap of the safety switch.
Figure 1C:
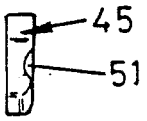
Figure 4:
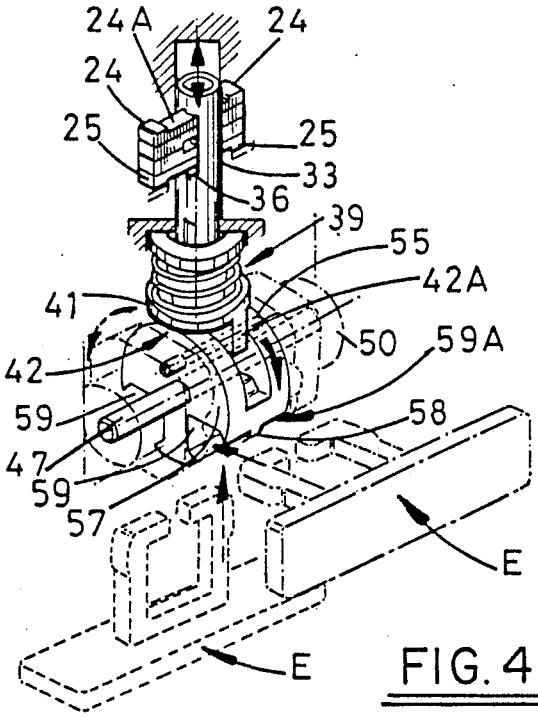
FIG. 4 is perspective view of the actuating cam means, the rod means and the actuator.
Figure 4A:
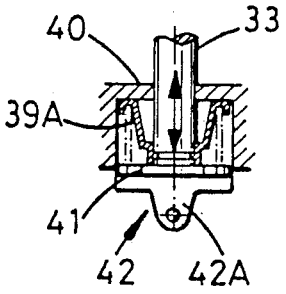
Figure 4B:
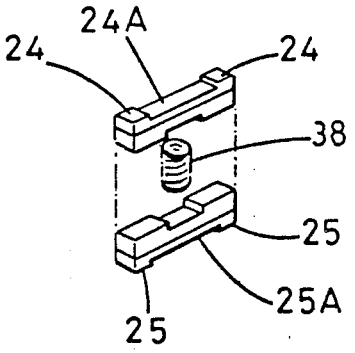

The safety switch assembly comprises two components, namely the safety switch A which contains an electrical contact arrangement B, an operating cam arrangement C, a connecting rod arrangement D as will be described hereinafter, and an actuator E which operationally cooperates with the safety switch A also as hereinafter described.

The safety switch A comprises a glass reinforced nylon casing 10 which is self-extinguishing.

The casing 10 defines an electrical contact compartment 11 at one end and, at its other end, has two parallel laterally-spaced walls 12 for mounting the cam arrangement C which will be described in detail later.

The contact compartment 11 is open to the front of the casing 10 and is closed by a faceplate 14 removable to permit access to the contact arrangement B also to be described later.

The faceplate 14 is secured in position on the casing 10 by a positioning tongue 15 at one end of the faceplate 14 engagable in a slot 16 and screws 17 engagable in screw holes 18 at the other end of the faceplate and complementary screw holes 19 in the casing 10.

Three conduit entry ports 20 to 22 are provided for passage of a conduited electrical cable (not shown) into the contact compartment 11 for securement to the contact arrangement B. Conduit entry ports 20 and 21 are disposed one at each side of the casing 10 while the conduit entry port 22 is disposed at what for convenience will be called hereinafter and in the claims the top of the casing 10. Each entry port 20 to 22 is normally closed by a plug 20A to 22A, a selected one of which is removed for entry of the conduited electrical cable depending upon the disposition of the safety switch casing 10 relative to the conduited electrical cable.

The contact arrangement B comprises one set of double positive break, normally-open safety contacts 23, 24 and one set of double positive break, normally-closed auxiliary contacts 25, 26.

The contacts 23 and 26 are fixed in position and are provided with wire conductor clamps 27 and 28 provided with Phillips locking screws 29 and 30. The casing 10 provides wire conductor guide and shielding walls 31 and 32 as indicated.

The sets of contacts 23, 24 and 25, 26 are axially-spaced relative to a hollow central rod 33 and the pairs of contacts 23, 24 and 25, 26 of each set are transversely spaced to opposite sides of the rod 33. Thus, at each side of the rod 33 is a pair of contacts 23, 24 and a pair of contacts 25, 26.

The rod 33 is closed at its top end by a wall 34 of the casing 10. The rod 33 is axially slit or slotted at two diametrically opposed locations 36 between the fixed contacts 23 and 26.

The contact pairs 24 and 25 extend through the slots 36. The contacts 24, 24 are connected by a bridge 24A and the contacts 25, 25 are similarly connected by a bridge 25A and a compression spring 38 extends between and acts on the bridges 24A, 25A to ensure electrical contact between contacts 23 and 24 and contacts 25 and 26 depending upon the operational mode of the safety switch.

Another compression spring 39 surrounds a spring retainer sleeve 39A and acts between a fixed horizontal wall 40 of the casing 10 and a boss or plate 41 integral with the bottom of the rod 33 to urge the latter downwards and the contacts 23, 24 and 25, 26 into their normal open and closed positions.

The integral boss or plate 41 is provided with an integral T-shaped formation 42, the stem 42A of the latter pointing to the bottom of the safety switch A.

The making of contacts 23, 24 and the breaking of contacts 25, 26, and vice versa, is effected by the axial push rod 33 and associated compression spring 38 and the cam arrangement C to which the push rod 33 is connected as later described.

Before describing the cam arrangement C in detail reference is firstly made to the laterally-spaced walls 12.

Each of these walls 12, on its outer face, is formed with two parallel spaced dovetail shaped locating and guide grooves 43 between which and centrally of the wall 12 is formed a hole 44.

The cam arrangement C comprises two anti-tamper locking cams 45 between which is sandwiched an actuator cam 46. The cams 45 and 46 are mounted on a shaft 47 supported at its ends in the holes 44 in the walls 12 which extends through a central hole 48 in each of the locking cams 45.

Each of the latter is constrained against rotational movement about the shaft 47 but is axially movable along the latter. Each locking cam 45, on its face adjacent to the inner face of the adjacent wall 12, is formed with an annular recess 49 in which engages one end of a compression spring 50, the other end of which bears against the inner face of the adjacent wall 12 between fore-and-aft ledges 12A thereof.

Each locking cam 45 is of circular disc-like configuration with flattened peripheral sides 45A, that is, two pairs of diametrically-opposed flat sides 45A.

These flat sides 45A cooperate with flat surfaces 10A on the housing 10 and above the locking cams 45 to resist rotation of the latter about the shaft 47.

The face of each locking cam 45 adjacent the actuator cam 46 has three relatively normally-spaced depressions 51 radiating inwardly towards the central hole 48 from a flattened side 45A, that is one depression 51 to each of three adjacent quadrants of the locking cam 45. The fourth quadrant is pierced by a hole 52 smaller in diameter than the central hole 48, the axes of the holes 48 and 52 being parallel and lying in the same diameter of the locking cam 45.

The actuator cam 46 is axially substantially thicker than the locking cams 45, is generally of circular configuration, and is rotatable about the shaft 47. The actuator cam 46 is peripherally split to a diameter at substantially half its area to define a forked configuration 53, whereof the limbs 54 are bridged by a pin 55 extending through arcuate cam slots 56 formed in the limbs 54 and projecting outwardly of the opposed faces 57 of the actuator cam 46 to engage in the holes 52 of the locking cams 45.

The pin 55 is fixed in the stem 42A projecting from both sides through the arcuate cam slots 56, the pin 55 resting normally in a central depression 56A of each arcuate cam slot 56. The pin 55 acts both as a locking pin and a cam follower pin.

The other half of the actuator cam 46 comprises a wall 58 centrally disposed relative to the axis of the actuator cam 46 and separating axially, to each side thereof, a pair of radial cut-outs or pockets 59 or 59A open to the periphery of the actuator cam 46, extending inwardly towards the spindle 47, and spaced angularly one to another. The shaft 47 extends through a central hole 60 in the actuator cam 46.

The pockets 59, 59A of the actuator cam 46 are normally open to the bottom of the safety switch.

The cam arrangement 13 is normally enclosed by an end cap 61 of box-like configuration open at one end with a pair of opposed projecting flanges 62, 63 (front and back), the end cap 61 at its flange 63 being formed with two screw holes 64 and an intervening window 65. The screw holes 64 are adapted to be aligned with two screw holes 66 or 66A provided respectively at the front and the back of the housing 10 to secure the end cap 61 in position on the latter. The flanges 62, 63 frictionally engage over a bar 67 at the front of the housing 10 and spaced projections 68 at the back of the housing 10 to locate and hold the end cap 61 in position before it is secured to the front or back of the housing 10 by screws 68A. The bar 67 is spaced from the body of the housing 10 to define the slot 16 within which the tongue 15 of the faceplate 14 is engagable. The end cap 61 at its back is formed with a groove or recess 61A for assisting liquid drainage out of the safety switch A through the window 65 and down the groove or recess 61A when the safety switch A is being hosed down for cleaning purposes.

A hole 10B provides communication between the part of the casing 10 enclosing the spring 39 and the exterior of the safety switch A. As a result any liquid therein is pumped out as the safety switch A is operated due to the axial movements of the push rod 33 and is diverted from reaching the contact arrangement B which would, of course, be very unsatisfactory and possibly dangerous.

The end cap 61 is formed at one corner with two rectangular openings 69, 70 spaced by a corner rib 71, the rectangular opening 69 defining a front actuator entry 69 and end the rectangular opening 70 defining an actuator entry 70. In this disposition of opening 69, 70 the screws 68 secure the end cap 61 to the casing 10 at the back.

By reversing the attitude of the end cap 61 so that it is secured by the screws 68 to the front of the housing 10 the front actuator entry 69 becomes a back actuator entry and the end actuator entry 70 while still remaining an end actuator entry is adjacent the rear of the safety switch as opposed to the front thereof. The end cap 61 thus permits two different pairs of entry dispositions to be selected to suit operational requirements, and, for this purpose, it is to be noted that actuator cam 46 is rotatable in either direction, clockwise or anti-clockwise.

Irrespective of which pair of actuator entries 69, 70 is selected, one of each is aligned a respective pair of pockets 59, 59A of the actuator cam 46.

The casing 10 at each side between the contact compartment 11 and the respective wall 12 is formed with a mounting formation 72 defining a securing hole 72A and a securing slot 73, either being adapted to receive a screw or other fastener (not shown) to suit the available mounting facility. A protective plate 74, of stainless steel for example, covers the front peripheral face of the mounting formation 71.

The other component of the safety switch, namely the actuator E is formed, for example of stainless steel. It comprises a securing bar 75 formed with screw holes 76, one adjacent each end, for receiving securing screws (not shown), and projecting from the front face of the securing bar 75 is a U-shaped member 77, whereof each limb 78 is inturned as indicated at 79 and is formed with a ramp or cam surface 80 on its exterior surface nearer the inturn 78 than the securing bar 75.

The abovedescribed safety switch A, actuator E can be used, inter alia, in connection with machinery guards, the safety switch A being mounted on the guard housing and the actuator E on the guard gate or door which may be hinged, slidable or of lift-off construction.

The electrical circuitry, well known to those skilled in the art of providing electrical interlocks between kinetic machinery and machine guards therefor, will not be described other than to indicate that machinery operation is inhibited until the safety contacts 23, 24 are closed and the auxiliary contacts 25, 26 are opened. The latter are signal contacts indicating the condition of the kinetic machinery and the machine guard in either condition, that is contacts 25, 26 closed indicates machinery in operation and machine guard closed, contacts 25, 26 open indicates machine guard open and machinery stopped.

Inadvertent or unauthorised rotation of the cam arrangement C is prevented or resisted by abutment of the spring-loaded locking cams 45 and housing surfaces 12A, the engagement of the loading cams 45 via the holes 52 with the fixed locking pin 55, and the location of the latter within the depressions 56A of the arcuate cam slots 56 formed in the limbs 54 of the actuator cam 46.

Figure 5A:
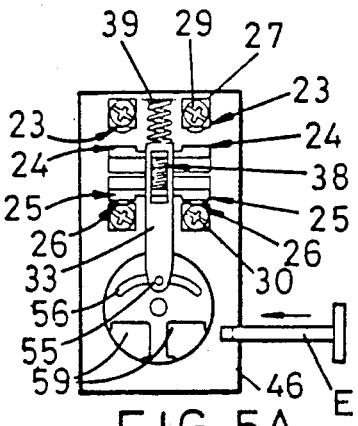
FIG. 5A to 5C are diagrammatic views showing the safety switch at rest (FIG. 5A) and operational (FIGS. 5B and 5C)
Figure 5B:
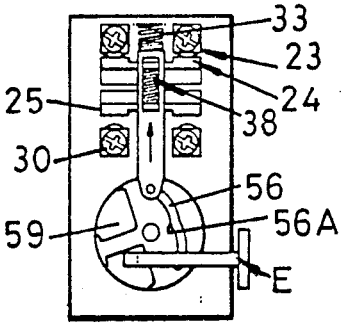
Figure 5C:
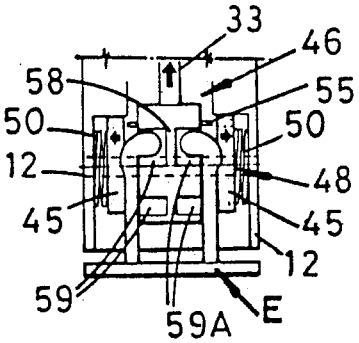
Figure 6:
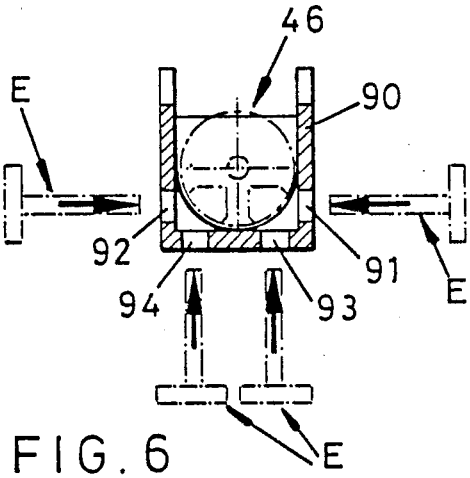
FIG. 6 is a diagrammatic sectional view of the end cap showing various modifications.

When the guard door or gate is closed, the actuator E enters the appropriate entry 69 or 70 (see FIGS. 5B and 5C). The limbs 78 of the actuator E engage simultaneously in the appropriate pockets 59 or 59A of the actuator cam 46 and between the actuator cam 46 and the locking cams 45 which forces the latter axially away from the actuator cam 46 along the shaft 47. This action causes compression of the springs 50, the locking cams 45 to disengage from the locking pin 55, and the ramped or cam surfaces 80 of the actuator limbs 78 to engage in a pair of the opposed depressions 51 in the faces of the locking cams 45 adjacent the actuator cam 46. At the same time, the latter is rotated causing one of the pairs of cam surfaces 56B at one side of the central depressions 56A to act on the locking pin 55, which now acts as a cam follower pin, to urge the boss or plate 41 and consequently the axial push rod 33 to move axially against the action of the spring 40 to open the auxiliary contacts 25, 26 and close the safety contacts 23, 24, which condition will prevail as long as the actuator E is so engaged in the safety switch A.

Retraction of the actuator E out of the safety switch A causes reversal of the contact conditions, that is contacts 23, 24, open and contacts 25, 26 close.

If the gate or door of the machinery guard is open only slightly, say, for example, 6 mm this will force disconnection of the safety contacts 23, 24 in the event of contact weld and safety switch component failure thus providing complete operator safety.

Additionally, the auxiliary signal contacts 25, 26 will then be closed instantaneously, to all intents and purposes, indicating the condition of the machinery guard.

It is to be noted that both sets of contacts 23, 24 and 25, 26 are galvanically isolated thus eliminating the possibility of voltage cross-over.

An alternative contact arrangement (not shown) comprises two pairs of double positive break, normally-open contacts for use in dangerous or low voltage applications. In this arrangement it is to be noted that both the safety normally-open contacts and the auxiliary normally-open contacts are forcibly disconnected almost simultaneously.

The abovedescribed safety switch and actuator A and E is installed by mounting the safety switch A at any convenient position of the machinery guard and the actuator E to an opening edge of the guard door or gate aligned with the appropriate entry 69 or 70.

In a modification (see FIG. 5), alternative entry arrangements are shown in the end cap designated 90 in this Figure. There may be only one entry at the front (see 91), or the rear (see 92), or the end adjacent the front (see 93), or the end adjacent the rear (see 94). There may be only two entries 91 and 94 or 92 and 93. There may be three entries provided selected from entries 91 to 94 inclusive.

In the case of only one entry, the actuator cam 46 need be provided only with one set of pockets 59 or 59A disposed adjacent the entry.

The actuating/locking cam and push rod arrangement of the present invention can be used in and to operate electrical switches other than that described with reference to the drawings and consequently the present invention also includes within its scope the actuating/locking cam and push rod arrangement per se.

What is claimed is:

1. A safety switch assembly comprising (A) a safety switch for securement to an enclosure having an openable closure, and (B) an actuator for operating the safety switch for securement to the closure; (C) the safety switch comprising a housing having laterally spaced wall means, an electrical contact arrangement contained within the housing, a cam arrangement also contained within the housing for operating the electrical contact arrangement and spaced from the electrical contact arrangement, radial pocket means formed in the cam arrangement and extending inwardly of the periphery of the cam arrangement, and axially-movable rod means connecting the electrical contact arrangement and the cam arrangement to operate the electrical contact arrangement in accordance with movements of the cam arrangement, the housing defining entry means adjacent the cam arrangement for insertion of the actuator into the housing to engage the radial pocket means to operate the cam arrangement, and the cam arrangement comprising shaft means bridging the wall means of the housing, actuating cam means rotatably supported on the shaft means, connecting means operatively securing the actuating cam means to the axially-movable rod means, the connecting means including cam follower pin means connected to the axially-movable rod means and cam groove means defined by the actuating cam means and within which the cam follower pin means is engaged, locking cam means also supported on the shaft means for movement along the shaft means, and resilient means between the locking cam means and housing wall means to urge the locking cam means towards the actuating cam means and into engagement with the cam follower pin means whereby the pin means serves releasably to lock the actuating cam means against rotation; and (D) the actuator comprising laterally-spaced limb means (i) insertible between the actuating cam means and the locking cam means to move the locking cam means along the shaft means away from the actuating cam means, and (ii) engagable with the actuating cam means to rotate the actuating cam means axially to move the rod means to operate the electrical contact arrangement.

2. A safety switch assembly as claimed in claim 1 in which the actuating cam means comprises an actuating cam having a body including a pair of laterally-spaced limbs defining a forked configuration in one diametral half of the body with each fork limb defining an arcuate cam slot, and the body being formed in the other diametral half thereof with two -axially-spaced pairs of angularly-spaced radial pockets constituting the radial pocket means.

3. A safety switch assembly as claimed in claim 2 in which a cam follower pin bridges and extends outwardly of each fork limb.

4. A safety switch assembly as claimed in claim 3 in which the axially movable rod means has an extension disposed between the fork limbs of the cam, and in which the cam follower pin is supported in and connected to the extension.

5. A safety switch assembly as claimed in claim 4 comprising, at each side of the actuating cam, a locking cam each comprising two opposed faces, namely a first face adjacent the actuating cam and a second face adjacent a wall means of the housing, and a compression spring between the second face and the wall means to urge the locking cam against the actuating cam.

6. A safety switch assembly as claimed in claim 5 in which each locking cam is formed with a plurality of flat peripheral edges, and the housing is formed with surfaces engagable by the flat peripheral surfaces to resist locking cam rotation about the shaft means.

7. A safety switch assembly as claimed in claim 6 in which each locking cam defines a hole aligned with the cam follower pin for receiving the pin to prevent rotation of the actuating cam.

8. A safety switch assembly as claimed in claim 7 in which the first face of each locking cam defines three radial depressions extending inwardly of the periphery thereof, the hole and the three radial depressions being spaced apart by 90°.

9. A safety switch assembly as claimed in claim 8 in which the actuator comprises a U-shaped member, the limbs of the U-shaped member having free ends inturned to engage the radial pocket means in the actuating cam means and outer edges of cammed or ramped construction for engagement with the depressions of the first faces of the locking cams.

10. A safety switch assembly as claimed in claim 5, in which the second face of each locking cam is formed with an annular groove within which is seated one end of the compression spring.

11. A safety switch assembly as claimed in claim 1 in which the contact arrangement comprises a set of normally-open safety contacts and a set of normally-closed safety contacts axially-spaced from the set of normally-open contacts, each contact set comprising a pair of fixed contacts and a pair of movable contacts, and the axially-movable rod means comprising a push rod resiliently supporting the pairs of movable contacts.

12. A safety switch assembly as claimed in claim 11 comprising compression spring means between an end of the push rod and a wall of the housing to urge the sets of contacts into their normally-open and normally-closed positions.

13. A safety switch as claimed in claim 12 comprising, in the housing, a drainage hole for egress of any liquid entering the housing.

14. A safety switch assembly as claimed in claim 1 in which the housing defines an open compartment for the contact arrangement, there being a faceplate provided removably to close the compartment.

15. A safety switch assembly as claimed in claim 14 in which the housing comprises a pair of laterally-spaced walls between which the cam arrangement is mounted, and an end cap for enclosing the walls and the cam arrangement.

16. A safety switch assembly as claimed in claim 15 in which the end cap defines the entry means for the actuator.

17. A safety switch assembly as claimed in claim 16 in which the entry means comprises a pair of separate entries spaced 90° apart for the actuator.

18. A safety switch assembly as claimed in claim 17 in which the end cap is reversible to reposition the locations of the pair of separate entries.

19. A safety switch arrangement as claimed in claim 15 in which the end cap is formed with a window and, on its rear face, a drainage groove for liquid run-off after cleaning of the safety switch.

20. A safety switch for securement to an enclosure having an openable closure adapted to mount an actuator for operating the safety switch comprising a housing having laterally-spaced wall means, an electrical contact arrangement contained within the housing, a cam arrangement also contained within the housing for operating the electrical contact arrangement and spaced from the electrical contact arrangement, radial pocket means formed in the cam arrangement and extending inwardly of a peripheral surface of the cam arrangement, and axially-movable rod means connecting the electrical contact arrangement and the cam arrangement to operate the electrical contact arrangement in accordance with movements of the cam arrangement the housing defining entry means adjacent the cam arrangement and through which a an actuator cam enter into the housing to engage the radial pocket means to operate the cam arrangement, and the cam arrangement comprising shaft means bridging the wall means of the housing, actuating cam means rotably supported on the shaft means, connecting means operatively securing the actuating cam means to the axially-movable rod means, the connecting means including cam follower pin means connected to the axially-movable rod means and cam groove means defined by the actuating cam means and with which the cam follower pin means is engaged, locking cam means also supported on the shaft for movement along the shaft means, and resilient means between the locking cam means and the housing wall means to urge the locking cam means towards the actuating cam means and into engagement with the cam follower pin means whereby the pin means serves releasably to lock the actuating cam means against rotation.

21. An actuator for operating a safety switch as claimed in claim 20, the actuator comprising laterally-spaced limb means (i) insertible between the actuating cam means and the locking cam means to move the locking cam means along the shaft means away from the actuating cam means, the limb means having free ends inturned to engage with the actuating cam means to rotate same and consequently axially to move the rod means to operate the electrical contact arrangement, and the limb means having cammed or ramped outer edges to force the actuating cam means and the locking cam means axially apart.

* * * * *